US006454683B1

(12) United States Patent
Kaye

(10) Patent No.: US 6,454,683 B1
(45) Date of Patent: Sep. 24, 2002

(54) CONVERTIBLE WORKOUT BENCH-COFFEE TABLE

(76) Inventor: John Kaye, 44 Nine Mile Rd., Rte. 2, Comstock Park, MI (US) 49321

( * ) Notice: Subject to any disclaimer, the term of this patent is extended or adjusted under 35 U.S.C. 154(b) by 0 days.

(21) Appl. No.: 09/327,435

(22) Filed: Jun. 7, 1999

(51) Int. Cl.[7] ..... A63B 26/00
(52) U.S. Cl. ..... 482/142; 482/904; 482/148
(58) Field of Search ..... 482/142, 104, 482/130, 133, 904; 297/119; 108/50.11, 13, 69, 77, 128; 312/235.2, 241

(56) References Cited

U.S. PATENT DOCUMENTS

| | | | | | |
|---|---|---|---|---|---|
| 1,158,779 | A | * | 11/1915 | Bolger | 482/904 |
| 2,258,782 | A | * | 10/1941 | McKean | 311/10 |
| 4,592,603 | A | * | 6/1986 | Adams et al. | 312/241 |
| 4,609,192 | A | | 9/1986 | Bratcher | |
| 4,765,616 | A | | 8/1988 | Wolff | |
| 5,242,345 | A | | 9/1993 | Mitchell | |
| 5,306,220 | A | * | 4/1994 | Kearney | 482/94 |
| 5,551,936 | A | * | 9/1996 | Parisi et al. | 482/142 |
| 5,611,762 | A | * | 3/1997 | Kaye | 482/104 |
| 6,174,026 | B1 | * | 1/2001 | Wise | 297/120 |

* cited by examiner

*Primary Examiner*—Michael A. Brown
*Assistant Examiner*—Lori Baker Amerson
(74) *Attorney, Agent, or Firm*—Reising, Ethington, Barnes, Kisselle, Learman & McCulloch PC

(57) ABSTRACT

The present invention relates to a workout bench-coffee table that is capable for use as a both a coffee table and a workout bench. In accordance with the present invention, the workout bench coffee table consists of a tri-fold resting portion, a base, and an incline means. The tri-fold resting portion is comprised of three panels, two outside panels hingedly connected to the center panel. Said outside panels each having a width essentially equal to ½ the width of the center panel. Each of said outside panel can fold onto the center panel, to expose a padding which the user can lay on for exercising, while placing their feet on the ground and laying on their back.

The tri-fold resting portion is supported by a base. The tri-fold resting portion can be raised by an incline means to allow the user to incline said base, to hold a barbell in a horizontal position so the user can perform the exercise known as, "bench pressing".

When not being used for exercising the tri-fold resting portion is "unfolded", exposing the wood side on the top, to be used as a table. The barbell, vertical weight bearing means, and accessories (dumbbells, weight-lifting belt, gloves) can be stored in the base by opening a base door and placing them inside the base.

3 Claims, 4 Drawing Sheets

CONVERTIBLE WORKOUT BENCH-COFFEE TABLE

BACKGROUND OF THE INVENTION

1. Field of the Invention

The present invention relates generally to both a coffee table and a workout bench, typically used for the exercises with dumbbells, and barbells, however, many diverse exercises can be used with most workout benches, and this invention also.

2. Description of Prior Art

Consumers, who exercise in their homes, typically have a workout bench. And of course coffee tables are commonplace. Prior to this invention, one would have to purchase a workout bench and a coffee table for two distinct functions; 1) working out, and 2) basic table uses, respectively. When not in use the workout bench, also known as a weight bench, would sit unused and take up space.

There are numerous prior art workout devices, and tables. However none embody the great benefit of space saving, aesthetic aura, and practicality of the present invention.

Innovations for workout benches and coffee tables have been provided in the prior art that are described as follows. Even though these innovations may be suitable for the specific individual purposes to which they address, they differ from the present invention as hereinafter contrasted.

U.S. Pat. No. 4,609,192 to Bratcher discloses a collapsible table, which can be set at different angles from the horizontal. This table is designed for massage. This table lacks the vertical arms necessary to hold a horizontal barbell for bench pressing and the like. U.S. Pat. No. 5,306,220 to Kearney is a frame, which holds weights and barbells for various exercises, and can not be used as a coffee table. U.S. Pat. No. 5,242,345 to Mitchell is an exercise apparatus, which is attached to a ceiling, and therefore does not function either as a weight bench or coffee table. U.S. Pat. No. 4,756,616 to Wolff disclose a typical workout bench, which has an adjustable incline for use as an inclined workout bench, which allows one to perform exercises at various angles.

U.S. Pat. No. 5,611,762 to Kaye, (the same inventor and applicant as in the present invention) functions in an entirely different manner. In U.S. Pat. No. 5,611,762, the weight bench or workout bench has two opposing sides that fold down (112), one of which must be folded down to be used as workout bench. U.S. Pat. No. , 5,611,762 has legs instead of a base. In the applicant's present invention, two opposing sides fold onto a resting portion, which eliminates the need to leave one side hanging down, and also reduces the size of the two opposing sides by ½. The applicant's present invention has a base instead of legs. The base can hold more weight, and the exercise dumbbells and accessories can be stored in the base by the use of the doors of the base. A leg weight apparatus can be added to the applicant's present invention. The applicants present invention has an incline means as well, so the user can perform inclined exercises.

Numerous innovations for either workout benches or coffee tables have been provided in the prior art that are adapted to be used. Even though these innovations may be suitable for the specific individual purposes to which they address, they would not be suitable for the purposes of the present invention as heretofore described.

SUMMARY OF THE INVENTION

In according with the present invention, the workout bench coffee table consists of a tri-fold resting portion, a base, and an incline means. The tri-fold resting portion is comprised of three panels, two outside panels hingedly connected to the center panel. Said outside panels each having a width essentially equal to ½ the width of the center panel. Each of said outside panel can fold onto the center panel, to expose a padding which the user can lay on for exercising, while placing their feet on the ground and laying on their back.

The tri-fold resting portion is supported by a base. The tri-fold resting portion can be raised by an incline means to allow the user for inclined exercises. Two vertical weight bearing means can be disposed on the sides of said base, to hold a barbell in a horizontal position so the user can perform the exercise known as, "bench pressing".

When not being used for exercising the tri-fold resting portion is "unfolded", exposing the wood side on the top, to be used as a table. The barbell, vertical weight bearing means, and accessories (dumbbells, weight-lifting belt, gloves) can be stored in the base by opening a base door and placing them inside the base.

Broadly considered, the invention comprises a combination workout bench-coffee table capable of allowing essentially one item to serve many different functions, including but not limited to exercising, and use as a coffee table. Accordingly, it is an object of the present invention to provide both a workout bench and coffee table.

More particularly, it is an object of the present invention to provide a household workout bench-coffee table capable of practical and quick conversion from one to the other. In keeping with these objects, and with others which will become apparent hereinafter, one feature of the present invention resides, briefly stated, in that the workout bench-coffee table is capable of use a strength training device which does not take up any extra space other than that of a coffee table.

When the workout bench-coffee table is designed in accordance with the present invention, it can provide the consumer with an economical and effective way to own both a coffee table and workout bench without extra space or cost.

In accordance with another feature of the invention, the workout bench-coffee table allows the user to perform traditional bench pressing, and dumbbell exercises, such as those known as "flys".

Another feature of the present invention is that the user can perform inclined bench presses by adjusting the resting portion.

Yet another feature of the present invention is that by adding leg exercise framing one can perform leg exercises.

Still another feature of the present invention is that the weight bearing means and accessories are easily removed and stored under the resting portion.

Still another feature of the present invention is that the weight bearing means can be adjusted in height whereby the height of the barbell, which the weight bearing means is holding, can be used for different people with different arm lengths.

Still another feature of the present invention is that the workout bench-coffee table can be fabricated from a material selected from a group consisting of plastic, plastic composites, fiberglass, Plexiglas, stainless steel, epoxy, carbon-graphite, glass, tempered glass, Lucite, wood, stone, metal, metal alloys and rubber composites.

The novel features which are considered characteristic for the invention are set forth in the appended claims. The invention itself, however, both as to its construction and its method of operation, together with additional objects and advantages thereof, will be best understood from the following description of the specific embodiment when read and understood in connection with the accompanying drawing.

BRIEF LIST OF REFERENCE NUMERALS UTILIZED IN THE DRAWING

EMBODIMENT ELEMENTS AND NUMBERS

100—convertible workout bench-coffee table 100

110—tri-fold resting portion 110

112—tri-fold resting portion center panel 112

114—tri-fold resting portion outside panel 114

116—tri-fold resting portion outside panel top face 116

118—tri-fold resting portion outside panel bottom face 118

120—means for hingedly connecting the tri-fold resting portion outside panels to the tri-fold resting portion center panel

122—base 122

124—incline means 124

126—base door 126

128—adjustable weight bearing means 128

130—leg weight apparatus 130

132—incline locking means 132

134—padding 134

136—angle braces 136

BRIEF DESCRIPTION OF THE PREFERRED EMBODIMENT

DETAILED DESCRIPTION OF THE PREFERRED EMBODIMENT

Figure 1:
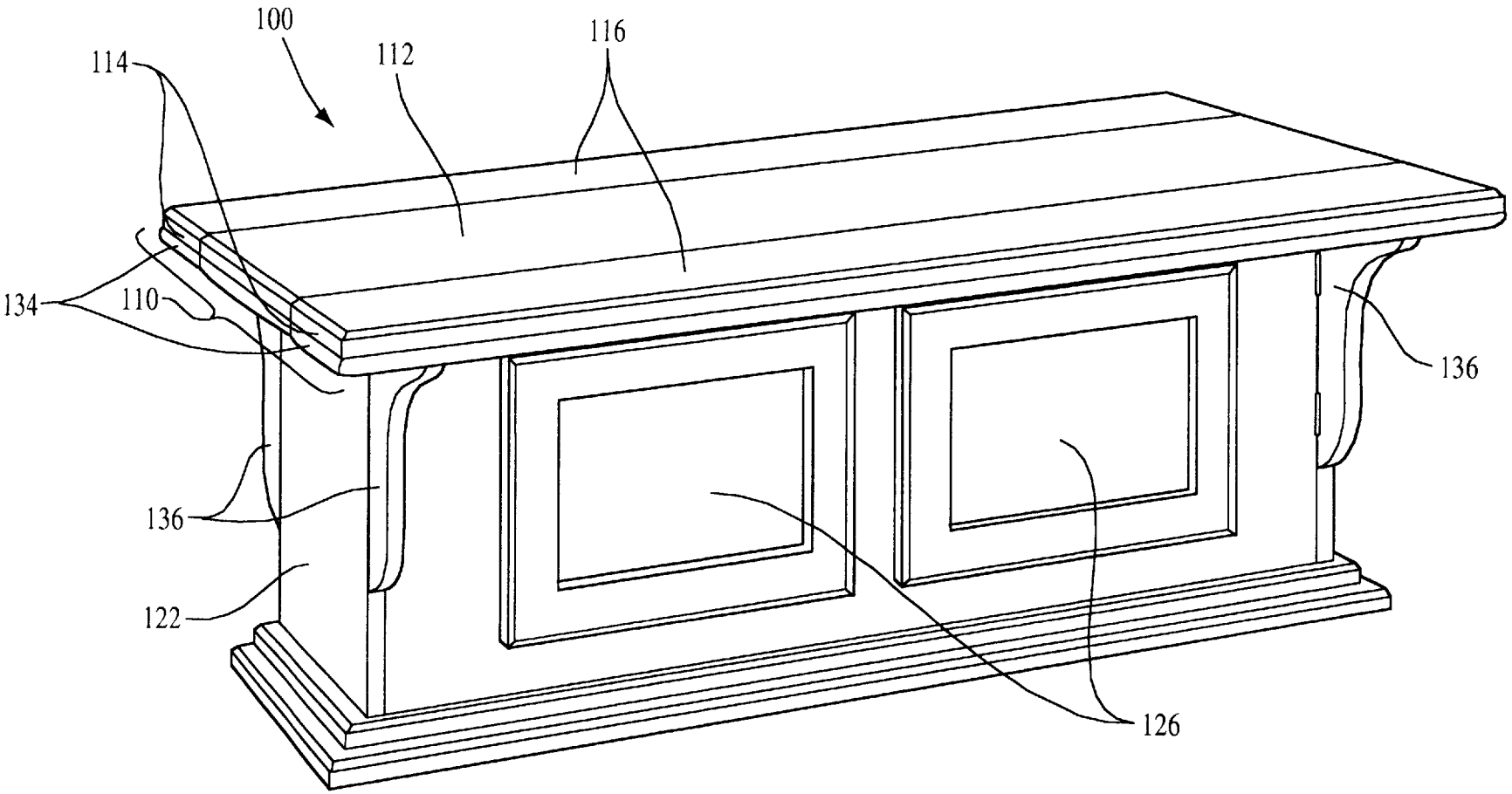
FIG. 1 is an isometric view of the convertible workout bench-coffee table 100 as it is used as a coffee table.

Firstly, referring to FIG. 1 which is an isometric view of the convertible weight bench-coffee table 100 exhibiting the following features; tri-fold resting portion 110 which consists of, tri-fold resting portion center panel 112 disposed between two (2) tri-fold resting portion outside panels 114. The tri-fold resting portion outside panel top face 116 is shown. The tri-fold resting portion outside panel top face 116 is the side which is optimal for use as a coffee table. The angle braces 136 are shown supporting the tri-fold resting portion outside panels 114. The base doors 126 are closed.

Figure 2:
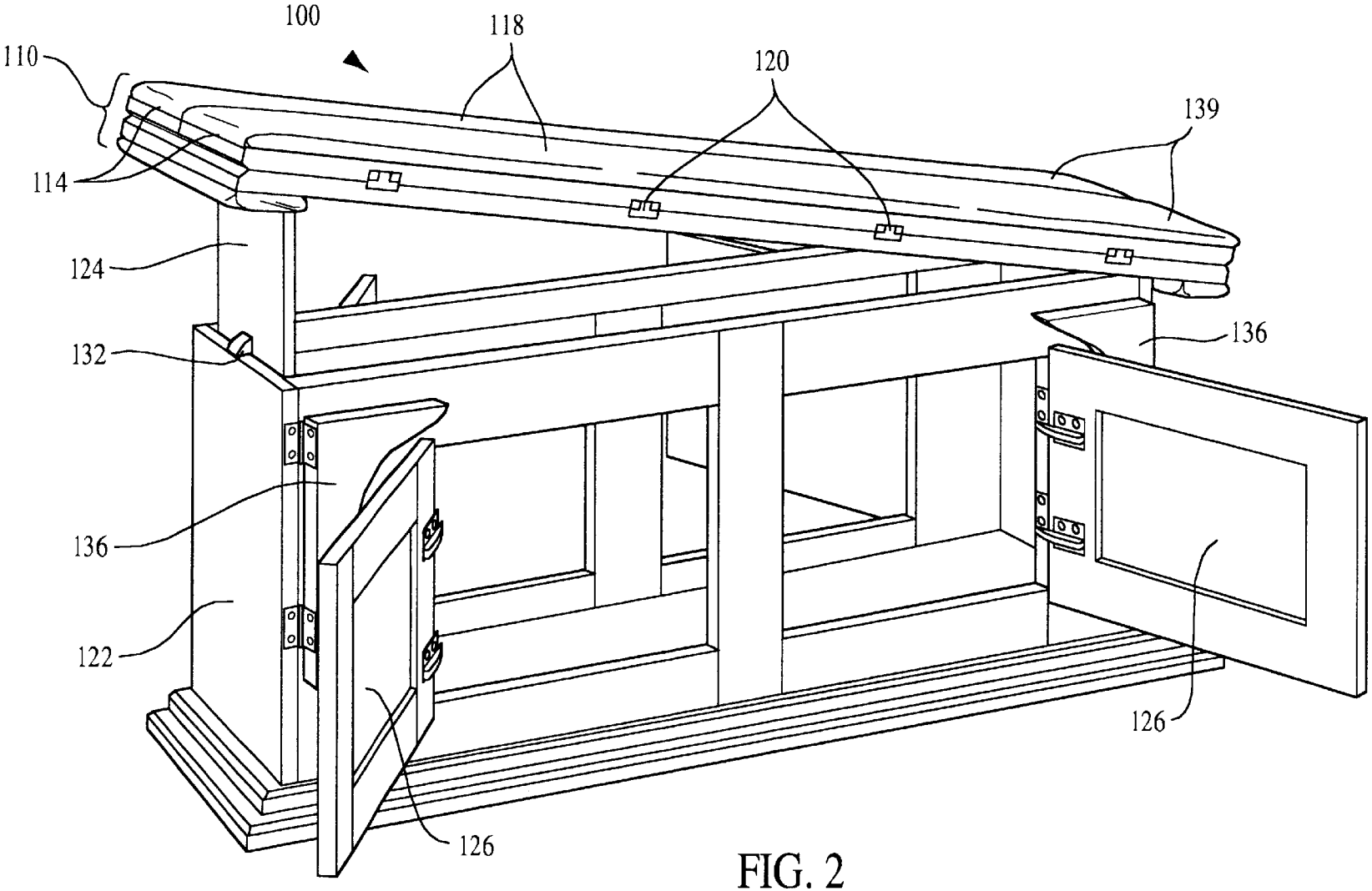
FIG. 2 is an isometric view of the convertible workout bench-coffee table 100 with each of the two tri-fold resting portion outside panels folded on top of the tri-fold resting portion center panel, and the tri-fold resting portion set at an incline. The base doors are open.

Referring to FIG. 2 which is an isometric view of the convertible workout bench-coffee table 100. The tri-fold resting portion outside panels 114 are folded by the means for hingeldy connecting the tri-fold resting portion outside panels to the tri-fold resting portion center panel 120, thereby the tri-fold resting portion outside panel bottom face 118, is exposed to the users back or spine. The tri-fold resting portion outside panel bottom face 118 can be padded for a more comfortable workout environment. The incline means 124 is shown which causes the tri-fold resting portion to be placed at an angle or incline. The tri-fold resting portion is prevented by sliding down to the horizontal by an incline locking means 132. The base doors are open.

Figure 3:
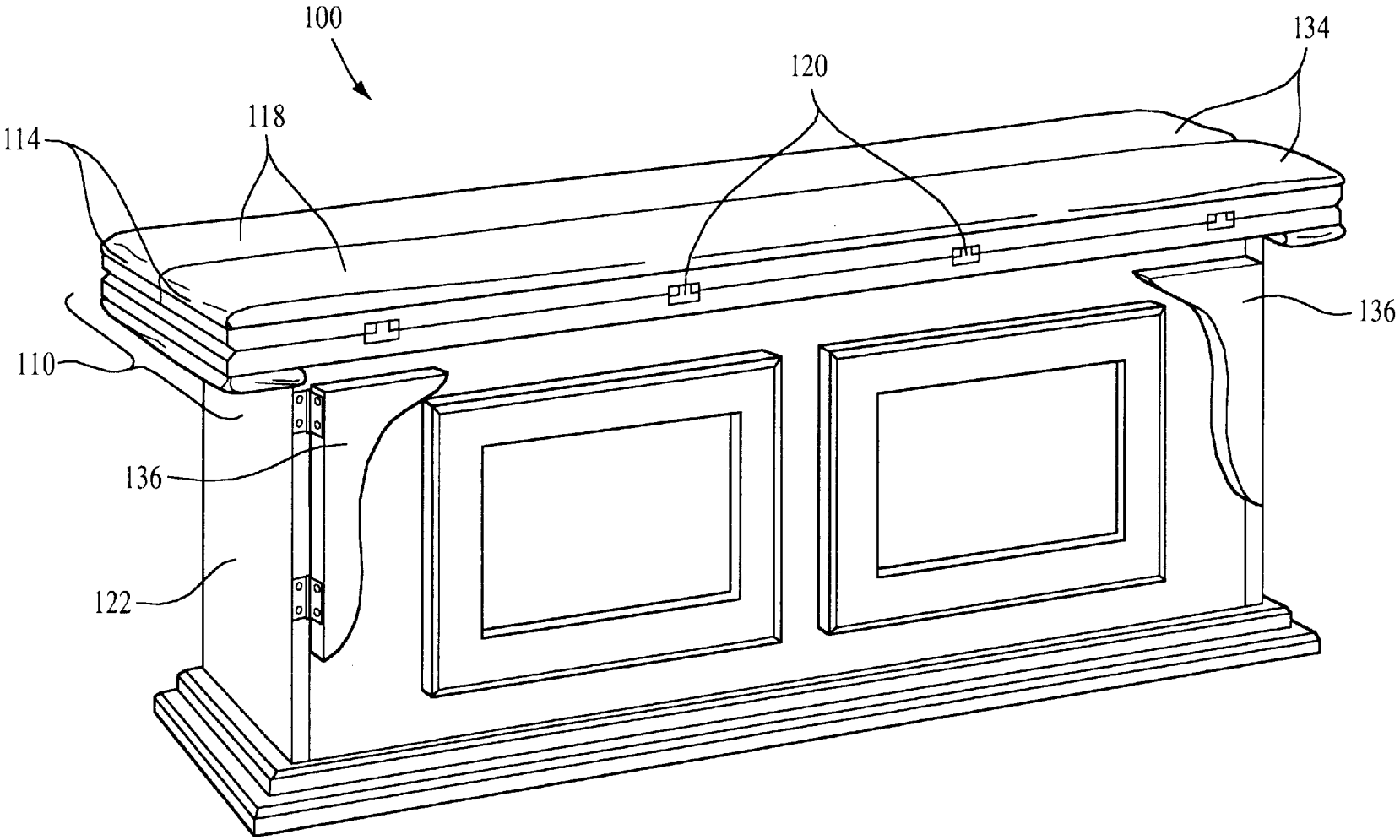
FIG. 3 is an isometric view of the convertible workout bench-coffee table 100 with each of the two tri-fold resting portion outside panels folded on top of the tri-fold resting portion center panel and the tri-fold resting portion set horizontally, at no incline. The base doors are closed.

Referring to FIG. 3 which is an isometric view of the convertible workout bench-coffee table 100. The tri-fold resting portion outside panels 114 are folded by the means for hingeldy connecting the tri-fold resting portion outside panels to the tri-fold resting portion center panel 120, thereby the tri-fold resting portion outside panel bottom face 118, is exposed to the users back or spine. The tri-fold resting portion outside panel bottom face 118 can be padded for a more comfortable workout environment. The base doors are open.

Figure 4:
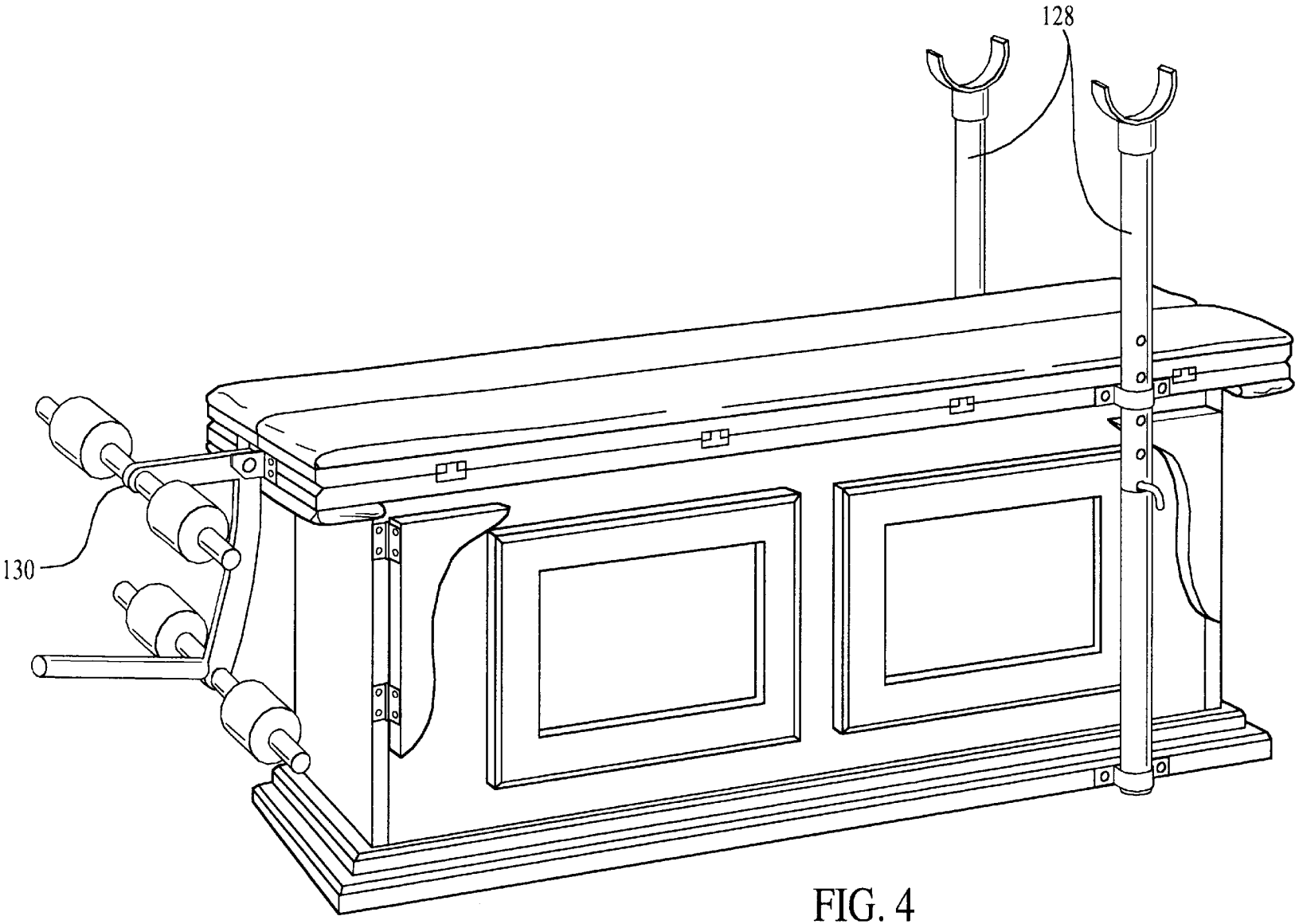
FIG. 4 is an isometric view of the convertible workout bench-coffee table 100 with each of the two tri-fold resting portion outside panels folded on top of the tri-fold resting portion center panel, and the tri-fold resting portion set horizontally, an no incline, with the vertical weight bearing means, and the leg weight apparatus attached.

Referring to FIG. 4 which is a front view of FIG. 3 with the adjustable weight bearing means 128, and the leg weight apparatus 130 attached.

The workout bench-coffee table 100 can be completely fabricated from a material selected from a group consisting of plastic, plastic composites, fiberglass, Plexiglas, stainless steel, epoxy, carbon-graphite, glass, tempered glass, Lucite, wood, stone, metal, metal alloys and rubber composites.

It will be understood that each of the elements described above, or two or more together, may also find a useful application in other types of constructions differing from the type described above.

While the invention has been illustrated and described as embodied in a workout bench-coffee table, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

I claim:

1. A convertible workout bench comprising:

a) a base having a top edge;

b) a tri-fold resting portion disposed on said top edge;

c) said tri-fold resting portion having a tri-fold resting portion center panel, and a tri-fold resting portion outside panel hingedly disposed to said tri-fold resting portion center panel, whereby the tri-fold resting portion can be used as a coffee table;

d) said tri-fold resting portion outside panel having a tri-fold resting portion outside panel top face and a tri-fold resting portion outside panel bottom face;

e) means for hingedly connecting the tri-fold resting portion outside panel to said tri-fold resting portion center panel, whereby at least one tri-fold resting portion outside panel can be folded to lay on top of said tri-fold resting portion center panel, whereby a human can lay their back on the tri-fold resting portion outside panel bottom face, with their feet placed on the ground whereby a leg weight apparatus is disposed on said base;

f) an incline means which can lock into place by an incline locking means.

2. A convertible workout bench comprising:

a) a base having a top edge;

b) a tri-fold resting portion disposed on said top edge;

c) said tri-fold resting portion having a tri-fold resting portion center panel, and a tri-fold resting portion outside panel hingedly disposed to said tri-fold resting portion center panel, whereby the tri-fold resting portion can be used as a coffee table;

d) said tri-fold resting portion outside panel having a tri-fold resting portion outside panel top face and a tri-fold resting portion outside panel bottom face;

e) means for hingedly connecting the tri-fold resting portion outside panel to said tri-fold resting portion center panel, whereby at least one tri-fold resting portion outside panel can be folded to lay on top of said tri-fold resting portion center panel, whereby a human can lay their back on the tri-fold resting portion outside panel bottom face, with their feet placed on the ground, whereby a leg weight apparatus is disposed on said base.

3. A convertible workout bench comprising:

a) a base having a top edge;

b) a tri-fold resting portion disposed on said top edge;

c) said tri-fold resting portion having a tri-fold resting portion center panel, and a tri-fold resting portion outside panel hingedly disposed to said tri-fold resting portion center panel, whereby the tri-fold resting portion can be used as a coffee table;

d) said tri-fold resting portion outside panel having a tri-fold resting portion outside panel top face and a tri-fold resting portion outside panel bottom face;

e) means for hingedly connecting the tri-fold resting portion outside panel to said tri-fold resting portion center panel, whereby at least one tri-fold resting portion outside panel can be folded to lay on top of said tri-fold resting portion center panel, whereby a human can lay their back on the tri-fold resting portion outside panel bottom face, with their feet placed on the ground, whereby an adjustable weight bearing means is disposed on said base, said weight bearing means extend upward from said base to allow the user to perform the exercise of bench pressing.

* * * * *